US008689892B2

(12) United States Patent
Noui-Mehidi

(10) Patent No.: US 8,689,892 B2
(45) Date of Patent: Apr. 8, 2014

(54) WELLBORE PRESSURE CONTROL DEVICE

(75) Inventor: Mohamed Nabil Noui-Mehidi, Dhahran (SA)

(73) Assignee: Saudi Arabian Oil Company (SA)

( * ) Notice: Subject to any disclaimer, the term of this patent is extended or adjusted under 35 U.S.C. 154(b) by 321 days.

(21) Appl. No.: 13/206,262

(22) Filed: Aug. 9, 2011

(65) Prior Publication Data

US 2013/0037275 A1 Feb. 14, 2013

(51) Int. Cl.
*E21B 33/12* (2006.01)

(52) U.S. Cl.
USPC ..... 166/386; 166/106

(58) Field of Classification Search
USPC ..... 166/370, 386, 106, 242.1
See application file for complete search history.

(56) References Cited

U.S. PATENT DOCUMENTS

| | | | | |
|---|---|---|---|---|
| 3,233,879 | A | 2/1966 | Mitchell | |
| 5,188,868 | A | 2/1993 | Horii et al. | |
| 6,382,317 | B1 * | 5/2002 | Cobb | 166/265 |
| 6,659,118 | B2 | 12/2003 | Lane et al. | |
| 6,730,236 | B2 * | 5/2004 | Kouba | 210/806 |
| 7,419,002 | B2 | 9/2008 | Dybevik et al. | |
| 7,828,067 | B2 | 11/2010 | Scott et al. | |
| 2008/0041581 | A1 | 2/2008 | Richards | |
| 2009/0008092 | A1 | 1/2009 | Haeberle et al. | |
| 2009/0095468 | A1 | 4/2009 | Augustine et al. | |
| 2009/0301730 | A1 | 12/2009 | Gweily | |
| 2011/0079396 | A1 | 4/2011 | Russell et al. | |

FOREIGN PATENT DOCUMENTS

| | | | |
|---|---|---|---|
| RU | 2148708 | C1 | 5/2000 |
| RU | 2248251 | C1 | 3/2005 |
| WO | 2002/075110 | A1 | 9/2002 |
| WO | 2009006672 | A1 | 1/2009 |

OTHER PUBLICATIONS

PCT Notification of Transmittal of the International Search Report and the Written Opinion of the International Searching Authority, or the Declaration; dated Jul. 12, 2013; International Application No. PCT/US2012/046837; International File Date: Jul. 16, 2012.

Bernt S. Aadnoy, Autonomous Flow Control Valve or "intelligent" ICD, pp. 1-9, http://www.hansenenergy.biz/HANSEN_Energy_Solutions/InflowControl2008B.pdf.

* cited by examiner

*Primary Examiner* — William P Neuder
(74) *Attorney, Agent, or Firm* — Bracewell & Giuliani LLP

(57) ABSTRACT

An apparatus for controlling fluid pressure, useful in the production of hydrocarbons from underground reservoirs comprises at least one conical segment. A conical segment comprises: an inner conical cylinder with a central axis; an outer conical cylinder, outside of, and coaxial with, the inner conical cylinder; and a swirl chamber disposed between a conical outer surface of the inner conical cylinder and a conical inner surface of the outer conical cylinder. There is a fluid entrance through a wall of the outer conical cylinder of at least one conical segment at an upstream end of the apparatus for directing fluids into such conical segment's swirl chamber. There is also a fluid exit through a wall of the inner conical cylinder of at least one conical segment at a downstream end of the apparatus for directing fluids out of such conical segment's swirl chamber.

13 Claims, 3 Drawing Sheets

WELLBORE PRESSURE CONTROL DEVICE

BACKGROUND OF THE INVENTION

1. Field of the Invention

The present invention relates to an apparatus and method for managing pressure in a wellbore. More specifically, the invention relates to the use of swirling fluids to maintain a wellbore at a desired pressure.

2. Description of the Related Art

In hydrocarbon producing wells, the wellbore may be completed by placing a casing inside the wellbore which is perforated along a producing or formation zone. Formation fluids generally contain a layer of gas above a layer of oil, which in turn is above a layer of water. The boundary between these 3 layers may not be consistent, making it difficult to produce only the desired fluid throughout the entire production length of the casing. Also, the formation itself may have irregular properties, or defaults that cause production to vary along the length of the casing. However, even flow along the perforated casing is usually desired.

Producing along the length of the wellbore at uneven rates may cause another of the formation zones to be produced. For example, in a oil producing well, water may begin to make its way into the casing in one localized area, significantly reducing oil production as well as the quality of the produced fluids. In order to maintain consistent production rates along the length of the perforated casing, one or more inflow control devices may be placed in the wellbore to assist in controlling the flow of fluids into the wellbore. Multiple fluid flow devices may be installed, each controlling fluid flows along a section of the wellbore. These fluid control devices may be separated from each other by conventional packers. Other benefits of using fluid control devices include increasing recoverable reserves, minimizing risks of bypassing reserves, and increasing completion longevity.

Prior art fluid control devices include both active flow control devices and passive flow control devices. Active flow control devices tend to be relatively expensive and include moving parts, which require maintenance and repairs, increasing costs and reducing reliability. Passive inflow control devices ("ICDs") that are able to control fluid flow into the wellbore are therefore desirable. Passive ICDs are reactive only and may restrict flow by creating a pressure drop or flow rate reduction in order to provide a more even production profile. In either case, current ICDs are susceptible to plugging or clogging, with little or no options for remediating the problem.

Therefore a passive ICD able to address the above concerns is desirable.

SUMMARY OF THE INVENTION

This invention is related to well production control by the use of ICDs that generate a designated pressure drop small enough to achieve pressure equalization within the wellbore along the formation to allow a homogenous production along a horizontal well section through a uniform movement of the oil-water contact front. Embodiments of the present application are able to meet these requirements while providing a cost effective, reliable and simple configuration that reduces the risk of clogging or other flow obstruction, thereby reducing maintenance and repair concerns.

In one embodiment of the current application, an apparatus for controlling fluid pressure, useful in the production of hydrocarbons from underground reservoirs comprises at least one conical segment, a conical segment comprising: an inner conical cylinder with a central axis; an outer conical cylinder, outside of, and coaxial with, the inner conical cylinder; and a swirl chamber disposed between a conical outer surface of the inner conical cylinder and a conical inner surface of the outer conical cylinder. There is a fluid entrance through a wall of the outer conical cylinder of at least one conical segment at an upstream end of the apparatus for directing fluids into such conical segment's swirl chamber. There is also a fluid exit through a wall of the inner conical cylinder of at least one conical segment at a downstream end of the apparatus for directing fluids out of such conical segment's swirl chamber.

Another embodiment of the current application further comprises a base plate located between two conical segments with a flow path through the base plate providing fluid communication between the swirl chambers of the two conical segments. The fluid entrance may be located in one of the conical segments and the fluid exit is located in the second conical segment and the flow path through the base plate may be tangential to a wall of the swirl chamber of at least one conical segment.

In another embodiment of the current application, the conical outer surface of the inner conical cylinder and the conical inner surface of the outer conical cylinder are angled relative to the central axis. The conical outer surface and the conical inner surface may angle convergently or divergently. The conical outer surface and the conical inner surface may be at an angle of less than 5 degrees relative to the central axis and may be at the same angle relative to the central axis.

Yet another embodiment further comprises a packer located at the upstream end of the apparatus and at a downstream end of the apparatus, and a production line located within and co-axial with the inner conical cylinder. The fluid exit provides a fluid communication between the swirl chamber of at least one conical segment and the production line.

In an alternative embodiment of the current application, a method for controlling fluid pressure, useful in the production of hydrocarbons from underground reservoirs comprises the steps of (a) providing at least one conical segment, a conical segment comprising: an inner conical cylinder with a central axis; an outer conical cylinder, outside of, and coaxial with, the inner conical cylinder; and a swirl chamber disposed between a conical outer surface of the inner conical cylinder and a conical inner surface of the outer conical cylinder, (b) forming a fluid entrance through a wall of the outer conical cylinder of at least one conical segment at an upstream end of the apparatus for directing fluids into such conical segment's swirl chamber, (c) forming a fluid exit through a wall of the inner conical cylinder of at least one conical segment at a downstream end of the apparatus for directing fluids out of such conical segment's swirl chamber, and (d) positioning the at least one conical segment within a wellbore between packers.

In another embodiment, the method may further comprise the steps of locating a base plate between two conical segments, and forming a flow path through the base plate tangential to a wall of the swirl chamber of at least one conical segment for providing fluid communication between the swirl chambers of the two conical segments.

In yet another embodiment of the current application, step (d) further comprises positioning the at least one conical segment outside of and co-axial with a production line such that the fluid exit provides a fluid communication between the swirl chamber of at least one conical segment and the production line.

BRIEF DESCRIPTION OF THE DRAWINGS

So that the manner in which the above-recited features, aspects and advantages of the invention, as well as others that will become apparent, are attained and can be understood in detail, a more particular description of the invention briefly summarized above may be had by reference to the embodiments thereof that are illustrated in the drawings that form a part of this specification. It is to be noted, however, that the appended drawings illustrate only preferred embodiments of the invention and are, therefore, not to be considered limiting of the invention's scope, for the invention may admit to other equally effective embodiments.

DETAILED DESCRIPTION OF THE EXEMPLARY EMBODIMENTS

Figure 1:
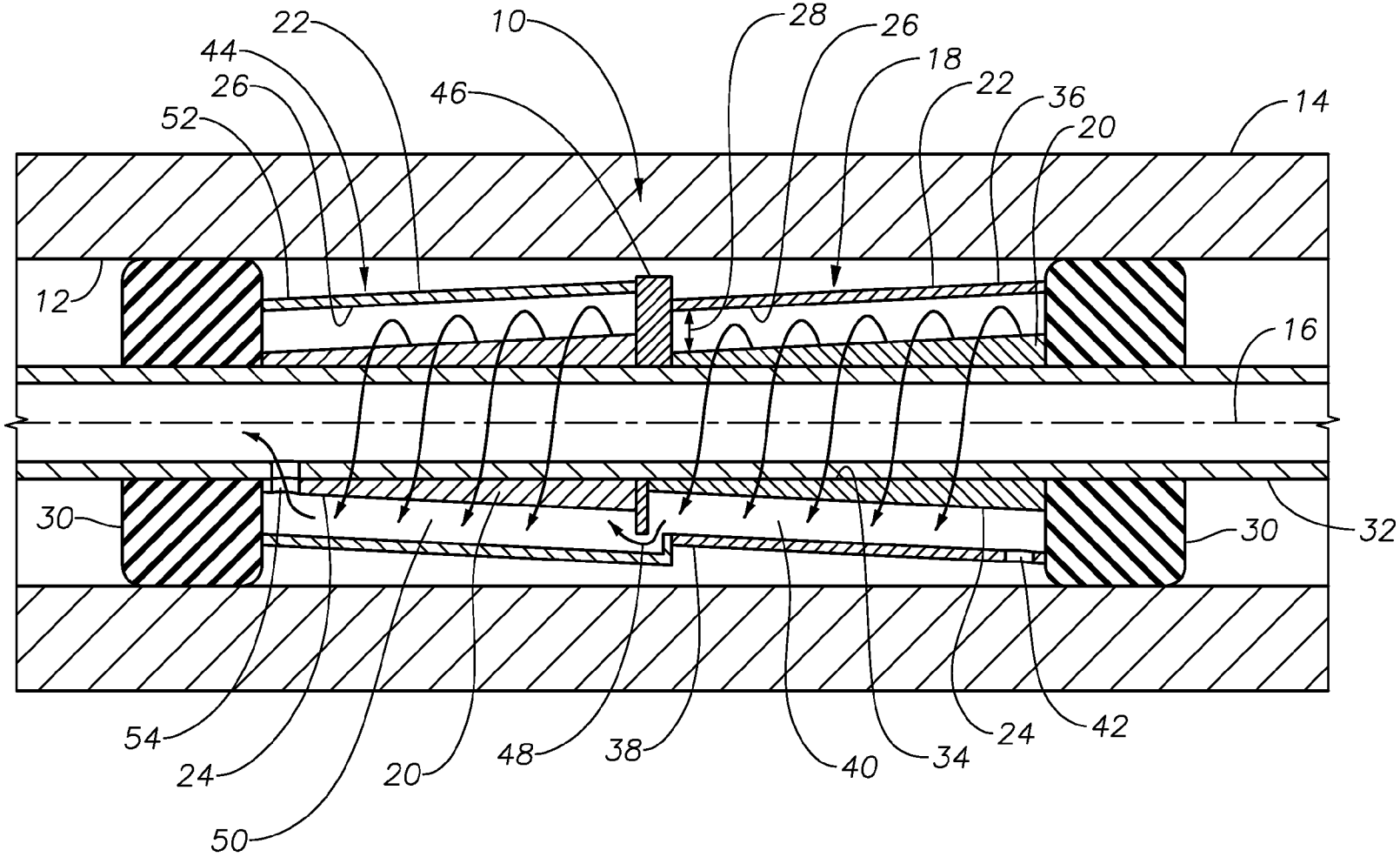
FIG. 1 is a sectional view of a pressure control device of the current application

As seen in FIG. 1, the pressure control device 10 may be situated within a bore 12 of conduit 14. Conduit 14 has a central axis 16 and may be, for example, production tubing within a cased well, or casing within a wellbore. A production line 32 with an axis co-linear to axis 16 may be situated within conduit 14. Device 10 is positioned within conduit 14 between packers 30, which seal the annulus between the conduit 14 and the production line 32. In alternative embodiments, there may be no production line 32 and device 10 instead communicates directly with fluids within conduit 14, in which case packers would seal the annulus between conduit 14 and the outside of device 10.

Device 10 consists of a first conical segment 18 which comprises an inner conical cylinder 20 and a concentric outer conical cylinder 22. Cylinders 20, 22 are coaxial with an axis co-linear to axis 16 Inner cylinder 20 has an inner surface 34 which surrounds, and comes into contact with, production line 32. Conical Segment 18 has a toe end 36 and a heel end 38. Toe end 36 is located downstream of heel end 38.

Inner cylinder 20 has an outer wall 24 that is angled relative to axis 16. This angle may be, for example, less than 5 degrees and in some embodiments may be 1 to 3 degrees. Outer cylinder 22 has an inner wall 26 that is angled relative to axis 16. This angle may be, for example, less than 5 degrees and in some embodiments may be 1 to 3 degrees. In order to maintain a constant annular gap width 28, between outer wall 24 of inner cylinder 20 and the inner wall 26 of outer cylinder 22, the angle of outer wall 24 and inner wall 26 relative to axis 16 may be the same and is known as the conical apex angle. In embodiments of the present invention, the bigger the conical apex angle, the shorter the swirl chamber and the larger the pressure drop due to a higher swirl motion.

Outer wall 24 of inner cylinder 20 has a smaller diameter than the inner wall 26 of outer cylinder 22. The space between outer wall 24 of inner cylinder 20 and inner wall 26 of outer cylinder 22 creates a swirl chamber 40. Swirl chamber 40 is an open annular channel without restriction. This open chamber design results in less erosion or friction losses compared to prior art devices and avoids clogging or flow obstruction problems.

Walls 24, 26 may angle convergently from toe end 36 to heel end 38, as shown in FIG. 1, to create a convergent swirl chamber 40. Alternatively, walls 24, 26 may angle divergently from toe end 36 to heel end 38, to create a divergent swirl chamber. However, it has been shown that a convergent swirl chamber has the advantage of maintaining a longer distance of the swirl flow before decaying. Outer cylinder 22 contains one or more fluid entrances 42 at its toe end 36.

In the embodiment of FIG. 1, the toe end 36 of first conical segment 18 is adjacent to a packer 30 and a second conical segment 44 is adjacent to the heel end of first conical segment 18. In alternative embodiments, there may be only one conical segment, or they may be more than two conical segments in each device 10. Second conical segment 44 has a circular base plate 46 which abuts the heel end of 38 of conical segment 18. A flow path 48 through base plate 46 fluidly connects the swirl chamber 40 of conical segment 18 to the swirl chamber 50 of conical segment 44. Swirl chamber 50 is open annular channel without restriction. The heel end 52 of conical segment 44, or where there is only one conical segment the heel end 38 of conical segment 18, comprises a fluid exit 54 which fluidly connects swirl chamber 50, or 40 as applicable, with the interior of production line 32. Fluid exit 54 is an opening through both inner cylinder 20 and production line 32. Conical segment 44 comprises similar components as conical segment 18 such as an inner conical cylinder 20 and a concentric outer conical cylinder 22 with axes co-linear to axis 16.

Figure 2A:
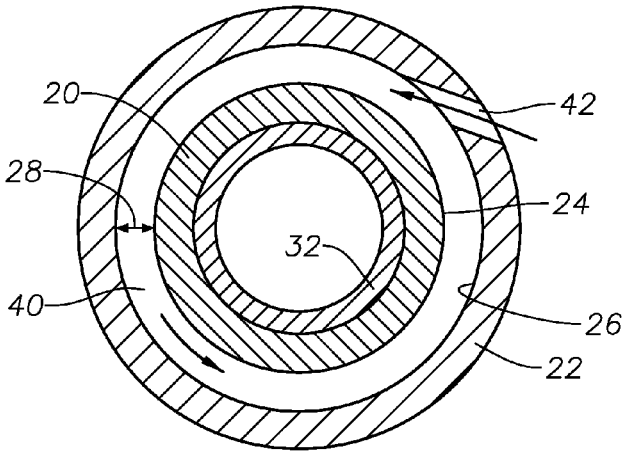
FIG. 2*a* is a sectional view of the pressure control device of FIG. 1.

In operation, fluid being produced from the well will pass through fluid entrance 42 and enter swirl chamber 40. As seen in FIG. 2*a*, fluid entrance 42 may be angled, such as tangential to the inner wall 26 so that well fluid enters the swirl chamber 40 tangentially relative to the to the inner wall 26 of outer cylinder 22 and then follows a helical path along the swirl chamber 40. The will fluids will follow such a helical path from the toe end 36 to the heel end 38 of conical segment 18.

Figure 2B:
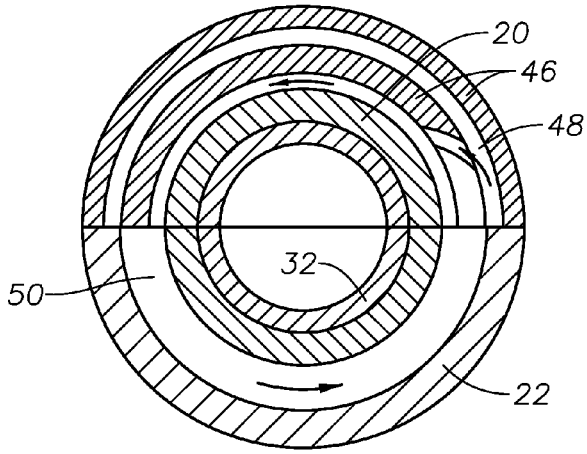
FIG. 2*b* is another sectional view of the pressure control device of FIG. 1, shown through different sections in proximity to the base plate.
Figure 3:
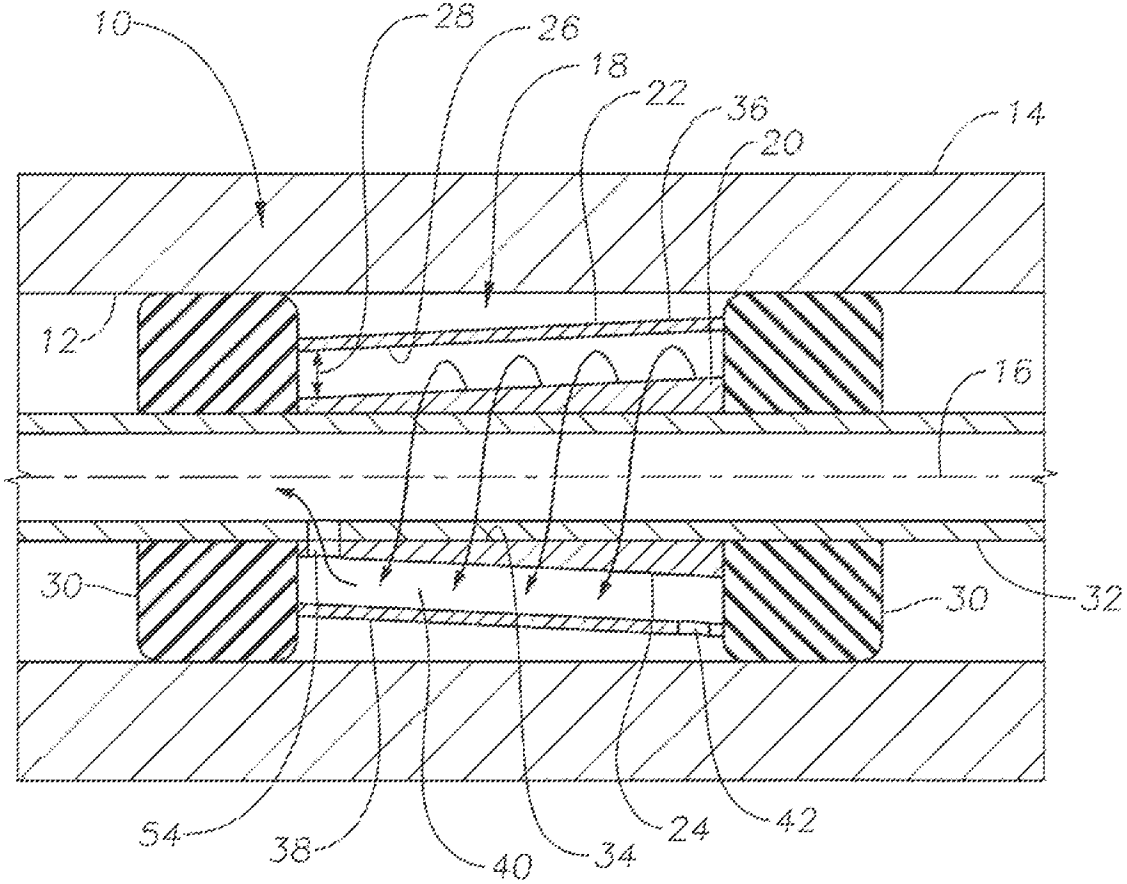
FIG. 3 is a sectional view of a pressure control device of the current application

In the embodiment of FIG. 1, after traveling the length of the first conical segment 18, the well fluids will pass through flow path 48 and into the swirl chamber 50 of second conical segment 44. Alternatively, after traveling the length of the first conical segment 18, the well fluids will pass through flow exit 54 and into the production line 32, as shown in FIG 3. As shown in FIG. 2*b*, flow path 48 may be angled relative to the walls 26, 24 defining swirl chamber 50 to cause the well fluid to be injected tangentially into swirl chamber 50. Having multiple conical segments arranged in series in fluid communication with each other in this manner helps to maintain an adequate swirl motion and prevents swirl decay.

Figure 2C:
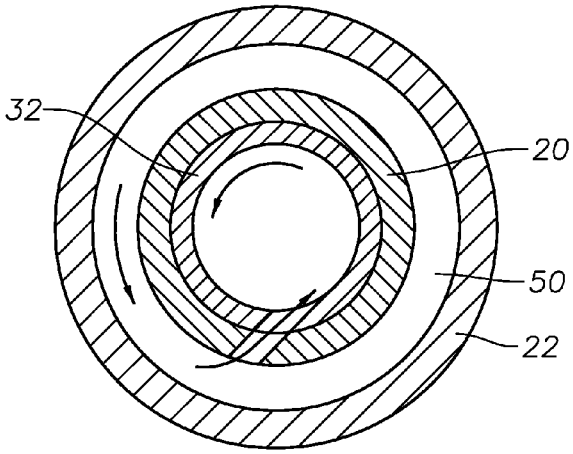
FIG. 2*c* is another sectional view of the pressure control device of FIG. 1.

In the embodiment of FIG. 1, after traveling the length of the second conical segment 44, the well fluids will pass through flow exit 54 and into the production line 32. As shown in FIG. 2*c*, flow exit 54 may be angled, such as tangential relative to the walls of production line 32, and cause the well fluid to be injected tangentially into production line 32.

In the present invention, the pressure drop associated with the concept of controlled swirl flow in the swirl chamber 40, swirl chamber 50, and any subsequent swirl chambers in device 10, if any, are used to achieve the desired pressure drop that would be effective as an equalization mechanism of the varying formation pressure along the length of the conduit 14. The swirl motion of the fluid in the swirl chambers is accompanied with a pressure drop that depends on the conical apex angle, the annular gap width 28, the geometry of the angled fluid entrance 42, and the geometry of flow path 48. These dimension and geometries will be designed to achieve the required pressure drop for each producing section of a particular wellbore, based on the known formation properties and other relevant physical parameters, for which device 10 is used. By adjusting only angled fluid entrance 42, the flow path 48, the conical apex angle and the annular gap width 28 of the conical cylinders, the embodiments of this application provide sufficient pressure control can be obtained within a wellbore.

Although the present invention has been described in detail, it should be understood that various changes, substitutions, and alterations can be made hereupon without departing from the principle and scope of the invention. Accordingly, the scope of the present invention should be determined by the following claims and their appropriate legal equivalents.

The singular forms "a", "an" and "the" include plural referents, unless the context clearly dictates otherwise. Optional or optionally means that the subsequently described event or circumstances may or may not occur. The description includes instances where the event or circumstance occurs and instances where it does not occur. Ranges may be expressed herein as from about one particular value, and/or to about another particular value. When such a range is expressed, it is to be understood that another embodiment is from the one particular value and/or to the other particular value, along with all combinations within said range.

Throughout this application, where patents or publications are referenced, the disclosures of these references in their entireties are intended to be incorporated by reference into this application, in order to more fully describe the state of the art to which the invention pertains, except when these reference contradict the statements made herein.

What is claimed is:

1. An apparatus for controlling fluid pressure, useful in the production of hydrocarbons from underground reservoirs comprising:

at least one conical segment, each conical segment comprising:

an inner conical cylinder with a central axis;

an outer conical cylinder, outside of, and coaxial with, the inner conical cylinder;

a swirl chamber disposed between a conical outer surface of the inner conical cylinder and a conical inner surface of the outer conical cylinder;

a fluid entrance through a wall of the outer conical cylinder of at least one conical segment at an upstream end of the apparatus for directing fluids into such conical segment's swirl chamber;

a fluid exit through a wall of the inner conical cylinder of at least one conical segment at a downstream end of the apparatus for directing fluids out such conical segment's swirl chamber.

2. The apparatus of claim 1, wherein the number of conical segments is two and further comprising:

a base plate located between the two conical segments; and a flow path through the base plate providing fluid communication between the swirl chambers of the two conical segments.

3. The apparatus of claim 2, wherein the fluid entrance is located in one of the conical segments and the fluid exit is located in the second conical segment.

4. The apparatus of claim 2, wherein the flow path through the base plate is tangential to a wall of the swirl chamber of at least one conical segment.

5. The apparatus of claim 1, wherein the conical outer surface of the inner conical cylinder and the conical inner surface of the outer conical cylinder are angled relative to the central axis.

6. The apparatus of claim 5, wherein conical outer surface and the conical inner surface angle convergently.

7. The apparatus of claim 5, wherein conical outer surface and the conical inner surface angle divergently.

8. The apparatus of claim 5, wherein the conical outer surface and the conical inner surface are at an angle of less than 5 degrees relative to the central axis.

9. The apparatus of claim 5, wherein the conical outer surface and the conical inner surface are at the same angle relative to the central axis.

10. The apparatus of claim 1, further comprising:

a packer located at the upstream end of the apparatus and a packer located at the downstream end of the apparatus;

a production line located within and co-axial with the conical cylinder; and wherein the fluid exit provides a fluid communication between the swirl chamber of at least one conical segment and the production line.

11. A method for controlling fluid pressure, useful in the production of hydrocarbons from underground reservoirs, the steps comprising:

(a) providing at least one conical segment, a conical segment comprising: an inner conical cylinder with a central axis, an outer conical cylinder, outside of, and coaxial with, the inner conical cylinder; and a swirl chamber disposed between a conical outer surface of the inner conical cylinder and a conical inner surface of the outer conical cylinder;

(b) forming a fluid entrance through a wall of the outer conical cylinder of at least one conical segment at an upstream end of the apparatus for directing fluids into such conical segment's swirl chamber;

(c) forming a fluid exit through a wall of the inner conical cylinder of at least one conical segment at a downstream end of the apparatus for directing fluids out of such conical segment's swirl chamber; and (d) positioning the at least one conical segment within a wellbore between packers.

12. The method of claim 11 wherein the number of conical segments is two and further comprising the steps of:

locating a base plate between the two conical segments; and forming a flow path through the base plate tangential to a wall of the swirl chamber of at least one conical segment for providing fluid communication between the swirl chambers of the two conical segments.

13. The method of claim 11, wherein step (d) further comprises positioning the at least one conical segment outside of and co-axial with a production line such that the fluid exit provides a fluid communication between the swirl chamber of at least one conical segment and the production line.

* * * * *

UNITED STATES PATENT AND TRADEMARK OFFICE

CERTIFICATE OF CORRECTION

PATENT NO. : 8,689,892 B2
APPLICATION NO. : 13/206262
DATED : April 8, 2014
INVENTOR(S) : Mohamed Nabil Noui-Mehidi It is certified that error appears in the above-identified patent and that said Letters Patent is hereby corrected as shown below:

In the Claims

In Column 5, line 46, the language "apparatus for directing fluids out such conical segment's" should read --apparatus for directing fluids out of such conical segment's--;

In Column 6, lines 19-20, the language "a production line located within and co-axial with the coni-" should read --a production line located within and co-axial with the inner conical cylinder; and wherein--;

In Column 6, line 45, the language "The method of claim 11 wherein the number of conical" should read --The method of claim 11, wherein the number of conical--.

Signed and Sealed this
Fifteenth Day of July, 2014

Michelle K. Lee

Michelle K. Lee
*Deputy Director of the United States Patent and Trademark Office*